US010105713B2

(12) United States Patent
De Oliveira Filho et al.

(10) Patent No.: US 10,105,713 B2
(45) Date of Patent: Oct. 23, 2018

(54) STABLE AQUEOUS COMPOSITION OF NEUTRAL COLLECTORS AND THEIR USE IN MINERAL BENEFICIATION PROCESSES

(71) Applicants: Clariant International Ltd., Muttenz (CH); Clariant S.A., Sao Paulo (BR); Clariant (Chile) Ltda., Santiago de Chile (CL)

(72) Inventors: Antonio Pedro De Oliveira Filho, São Paulo (BR); Jesus Pitarch López, Frankfurt am Main (DE); Wagner Claudio Da Silva, São Paulo (BR); Gunter Lipowsky, Ladenburg (DE); Jacques Collin Bezuidenhout, Steinbach (DE); Jaime Osvaldo Gomez Becerra, Maipú-Santiago (CL); Rodrigo Alexis Caris Andrade, Las Condes-Santiago (CL); Franco Aurelio Constanzo Yanez, Chicuero-Santiago (CL)

(73) Assignees: CLARIANT INTERNATIONAL LTD., Muttenz (CH); CLARIANT S.A, Sao Paulo (BR); CLARIANT (CHILE) LTDA., Santiago de Chile (CL)

( * ) Notice: Subject to any disclaimer, the term of this patent is extended or adjusted under 35 U.S.C. 154(b) by 0 days.

(21) Appl. No.: 15/325,916

(22) PCT Filed: Apr. 22, 2015

(86) PCT No.: PCT/EP2015/000840
§ 371 (c)(1),
(2) Date: Jan. 12, 2017

(87) PCT Pub. No.: WO2016/008554
PCT Pub. Date: Jan. 21, 2016

(65) Prior Publication Data

US 2017/0165681 A1 Jun. 15, 2017

(30) Foreign Application Priority Data

Jul. 14, 2014 (EP) ..... 14002420

(51) Int. Cl.
*B03D 1/02* (2006.01)
*B03D 1/012* (2006.01)
*B03D 1/008* (2006.01)
*C22B 3/16* (2006.01)

(52) U.S. Cl.
CPC ..... *B03D 1/012* (2013.01); *B03D 1/008* (2013.01); *B03D 1/02* (2013.01); *C22B 3/1658* (2013.01)

(58) Field of Classification Search
CPC ..... B03D 1/02; B03D 1/012; B03D 1/008; B03D 1/06; C22B 3/1658
See application file for complete search history.

(56) References Cited

U.S. PATENT DOCUMENTS

| | | | | |
|---|---|---|---|---|
| 3,464,551 | A * | 9/1969 | Falvey | B03D 1/012 209/166 |
| 3,925,218 | A * | 12/1975 | Zipperian | B03D 1/012 209/166 |
| 4,040,950 | A * | 8/1977 | Zipperian | B03D 1/012 209/166 |
| 2015/0090666 | A1* | 4/2015 | Counter | B03D 1/023 210/705 |

FOREIGN PATENT DOCUMENTS

| | | |
|---|---|---|
| AU | 2013206605 | 1/2014 |
| CN | 1608469 | 4/2005 |
| EP | 2017009 A1 * | 1/2009 |
| GB | 2160101 | 12/1985 |

(Continued)

OTHER PUBLICATIONS

International Search Report for PCT/EP2015/000840, dated Aug. 10, 2015.
International Preliminary Report on Patentability for PCT/EP2015/000840, dated Aug. 10, 2015.
Froth Flotation—A Century of Innovation by Fuerstenau, M., Jameson, G. & Yoon. R.(2007).
"Emulsion Formation and Stability" ed. By Tharwat F. Tadros, Wiley-VCH 2013.
English Abstract for CN1608469, Apr. 27, 2005.

*Primary Examiner* — Thomas M Lithgow
(74) *Attorney, Agent, or Firm* — Tod A. Waldrop

(57) ABSTRACT

The instant invention relates to a composition in form of a stable aqueous emulsion comprising a) 1-50 wt.-% of at least one water insoluble thionocarbamate collector selected from the group consisting of dialkyl thionocarbamates, alkyl alkoxycarbonyl thionocarbamates and alkyl allyl thionocarbamates, b) 1-50 wt.-% of one or a mixture of surface active agents of the general formula

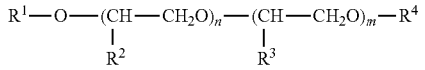

wherein $R^1$ is a saturated or unsaturated, branched or linear $C_3$ to $C_{30}$ aliphatic or aromatic hydrocarbon group, $R^2$ and $R^3$ are independently from each other hydrogen or a $C_1$ to $C_4$ alkyl group, $R^4$ is hydrogen or —$CH_2$—COOX where X is hydrogen or sodium salt or potassium salt or ammonium salt, and n and m are independently from each other 0 to 50, c) 0.1-20 wt.-% of a mixture of at least one alcohol and at least one ether and/or ester, e) 1-90 wt.-% of water.

23 Claims, No Drawings

(56) References Cited

FOREIGN PATENT DOCUMENTS

| | | | |
|---|---|---|---|
| WO | WO 97/25149 | * | 7/1997 |
| WO | WO 2014012139 | | 1/2014 |

* cited by examiner

STABLE AQUEOUS COMPOSITION OF NEUTRAL COLLECTORS AND THEIR USE IN MINERAL BENEFICIATION PROCESSES

This invention relates to a novel aqueous composition of water insoluble thionocarbamate collectors and their use in the flotation of sulfide minerals. The use of the novel compositions provides improved flotation efficiency.

Froth flotation is a well-known process for mineral beneficiation based on the treatment of aqueous slurries of ore particles with collectors, which are molecules able to bind preferentially to the surface of value mineral particles and render them hydrophobic, so that they become easily attached to the air bubbles generated in the flotation cell and rise to the froth, whereas gangue materials remain preferentially in the aqueous slurry.

In the case of sulfide beneficiation, concerning the flotation of minerals containing such metals as copper, lead, copper-activated zinc, gold and silver, water insoluble thionocarbamate collectors are broadly used due to their high selectivity towards the value minerals. In contrast to other collectors such as xanthates, thionocarbamate type collectors typically give much better selectivity against iron sulphides. However, due to their water insolubility characteristic, special treatments like collector addition to the grinding circuit or other conditioning steps have been adapted in order to ensure effective usage of thionocarbamates. This is a limiting effect as the product can only be added to very specific points in the flotation plant.

It therefore would be beneficial for the flotation industry if aqueous compositions of thionocarbamate collectors would be available. These products could be readily used and would not require special treatment- and/or additional-steps in the flotation circuit. These formulations are expected to show improved flotation efficiency compared to the pure, non-formulated version. Improved flotation efficiency means that for the same effective collector dosage, indicated as grams of thionocarbamate per tonne of ore, higher metal recovery and/or grade is achieved.

WO 9725149 discloses aqueous compositions of dialkyl thionocarbamate collectors as oil-in-water emulsions comprising dialkyl thionocarbamate collector in an amount of 5 to 95 wt.-%, emulsifier in an amount of 1 to 30 wt.-% and water in an amount of 5 to 95 wt.-%. As emulsifier a 50:50 wt.-% blend of ethoxy (20) sorbitan monolaurate and ethoxy (100) stearic acid is described. The use of the emulsion leads to a better zinc recovery than pure dialkyl thionocarbamate at same dosage.

It is also known that mixtures of thionocarbamates with other collectors can be of advantage in mineral beneficiation and improved flotation can be achieved from their use. However, stability problems are normally associated with such collector mixtures, especially when aqueous anionic collectors are mixed with water insoluble thionocarbamate collectors, since frequently the components tend to separate and then the mixture has to be continuously stirred before addition to the flotation circuit, circumstance which increases complexity and costs in the flotation process.

WO 2014012139 discloses that the combination of one or more monothiophosphate collectors with one or more thionocarbamates collectors gives stable mixtures which show improved flotation efficiency.

The present invention is related to the improvement of the flotation efficiency of water insoluble thionocarbamate collectors. Under flotation efficiency is meant a higher metal recovery and/or grade at the same collector dosage, indicated as grams of thionocarbamate per tonne of ore. It was one other object of the instant invention to provide a collector composition that will not show emulsion separation for at least three months.

The term water insoluble means in this text that the solubility in water is less than 10 g/liter at 20° C. determined according to the OECD guideline 105. The term water soluble means in this text that the solubility in water is 10 g/liter at 20° C. or higher, determined according to the OECD guideline 105.

Unexpectedly it was found that stable aqueous compositions containing 0.1-20 wt.-% of a mixture of at least one alcohol and at least one ether and/or ester additionally to water insoluble thionocarbamate collectors and emulsifiers can be formulated which show an improved flotation efficiency in comparison to aqueous compositions containing only emulsifiers and water insoluble thionocarbamate collectors.

Furthermore, it was also surprisingly found that stable aqueous compositions showing improved flotation efficiency can be formulated which also may contain up to 50 wt.-% of anionic, water soluble collectors additionally to emulsifiers, water insoluble thionocarbamate collectors and 0.1-20 wt.-% of a mixture of at least one alcohol and at least one ether and/or ester.

The instant invention therefore relates to a composition in form of a stable aqueous emulsion comprising a) 1-50 wt.-% of at least one water insoluble thionocarbamate collector selected from the group consisting of dialkyl thionocarbamates, alkyl alkoxycarbonyl thionocarbamates and alkyl allyl thionocarbamates, b) 1-50 wt.-% of one or a mixture of surface active agents of the general formula

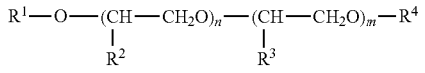

wherein $R^1$ is a saturated or unsaturated, branched or linear $C_3$ to $C_{30}$ aliphatic or aromatic hydrocarbon group, $R^2$ and $R^3$ are independently from each other hydrogen or a $C_1$ to $C_4$ alkyl group, $R^4$ is hydrogen or —$CH_2$—COOX where X is hydrogen or sodium salt or potassium salt or ammonium salt, and n and m are independently from each other 0 to 50, c) 0.1-20 wt.-% of a mixture of at least one alcohol and at least one ether and/or ester.

e) 1-90 wt.-% of water.

The aqueous emulsion is considered to be stable if it does not separate for at least three months.

Preferred water insoluble thionocarbamate collectors (component a) suitable to formulate compositions in accordance with the present invention are selected from the group consisting of dialkyl thionocarbamates, alkyl alkoxycarbonyl thionocarbamates and alkyl allyl thionocarbamates and have the general formula

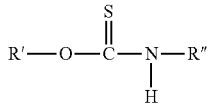

wherein

R" is a branched or linear $C_1$ to $C_4$ aliphatic saturated hydrocarbon group, R" is hydrogen or a branched or linear $C_1$ to $C_4$ aliphatic saturated hydrocarbon group or a vinyl group or a group of formula —COOY wherein Y is a branched or linear $C_1$ to $C_4$ aliphatic hydrocarbon group.

The expression "aliphatic saturated hydrocarbon group" means preferably an alkyl group.

Specially preferred dialkyl thionocarbamates are O-isopropyl-N-ethyl thionocarbamate, O-isobutyl-N-ethyl thionocarbamate, O-isopropyl-N-methyl thionocarbamate, O-isobutyl-N-propyl thionocarbamate and O-butyl-N-ethyl thionocarbamate. Specially preferred alkyl alkoxycarbonyl thionocarbamate are O-isobutyl-N-ethoxycarbonyl thionocarbamte, O-butyl-N-butoxycarbonyl thionocarbamate, O-methyl-N-butoxycarbonyl thionocarbamate, O-ethyl-N-butoxycarbonyl thionocarbamate and O-propyl-N-butoxycarbonyl thionocarbamate. Specially preferred alkyl allyl thionocarbamates are O-methyl-N-allyl thionocarbamate, O-ethyl-N-allyl thionocarbamate, O-propyl-N-allyl thionocarbamte, O-butyl-N-allyl thionocarbamate and O-isobutyl-N-allyl thionocarbamate. The concentration of the preferred thionocarbamate or mixture of thionocarbamate collectors present in compositions in accordance with the present invention ranges from 1 to 20 wt.-%.

Preferred surface active agents (which act as emulsifiers) (component b)) useful to make stable aqueous compositions of insoluble thionocarbamate collectors according to the present invention correspond to the general formula

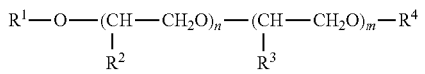

wherein $R^1$ is a saturated or unsaturated, branched or linear $C_3$ to $C_{18}$ aliphatic hydrocarbon group, preferably an alkyl or alkenyl group.

The more preferred lower limit of the chain length of $R^1$ is 4 carbon atoms.

Preferably, $R^2$ and $R^3$ are independently from each other hydrogen or methyl.

Preferably, $R^4$ is hydrogen or —$CH_2$—COOX where X is hydrogen or sodium salt or potassium salt or ammonium salt. In a more preferred embodiment $R^4$ is hydrogen.

Preferably, n and m are independently from each other 1 to 40.

The concentration of the emulsifier present in compositions in accordance with the present invention preferably ranges from 1 to 10 wt.-%.

Preferably, the alcohol present in component c) is a monohydric alcohol or a diol. Preferably, the hydrocarbon radical of said alcohol is an alkyl radical in case of the monohydric alcohol or an alkylene radical in case of the diol which can be linear or branched. Particularly preferably, the hydrocarbon radical contains 8 to 14 carbon atoms. The preferred alcohols have a solubility in water less than 50 g/liter at 20° C. determined according to the OECD guideline 105. Partial esters also count as alcohol in the context of this invention.

In one preferred embodiment, the alcohol which forms part of component c) is 2-ethylhexanol and/or 2-ethylhexane-(1,3)-diol.

Preferably, the ethers present in component c) correspond to following formula $$R^5—O—R^6$$

wherein $R^5$ is linear or branched alkyl or alkenyl groups having 2 to 30 carbon atoms and $R^6$ is linear or branched alkyl or alkenyl groups having 1 to 30 carbon atoms.

Preferably, the esters present in component c) are derived from monobasic or polybasic carboxylic acids having 2 to 30 carbon atoms (acid radical) and monohydric or polyhydric alcohols having 1 to 30 carbon atoms (alcohol radical). The expression "radical" with respect to the acid means the acid molecule excluding the carboxylic (—COON) group or groups. The expression "radical" with respect to the alcohol means the alcohol molecule excluding the hydroxyl (—OH) group or groups. A polybasic acid is preferably two, three or four basic, particularly two basic.

The ethers and/or esters may be cyclic, wherein the ring size is from 6 to 30 carbon atoms.

"Derived" in the present case is taken to mean that the esters can be obtained by reacting monobasic or polybasic carboxylic acids having 2 to 30 carbon atoms with monohydric or polyhydric alcohols having 1 to 30 carbon atoms.

$R^5$ and the acid radical are preferably linear or branched alkyl or alkenyl groups having at least 4 carbon atoms, in particular at least 5, up to 22 carbon atoms. $R^6$ and also the alcohol radical are preferably linear or branched alkyl or alkenyl groups having at least 2 carbon atoms, in particular at least 4 to 22 carbon atoms. The alcohols preferably contain no more OH groups than carbon atoms.

Examples of ethers which may be mentioned are dihexyl ether, dioctyl ether, di-(2-ethylhexyl) ether, examples of esters which may be mentioned are oleic acid eicosyl ester, 2-ethylhexyl stearate, 2-ethylhexylic acid butyrate, octanoic acid ethyl ester, hexanoic acid ethyl ester, 2-ethylhexylic acid butyl ester, 2-ethylhexyl butyrate and 2-ethylhexylic acid 2-ethylhexyl ester.

In a further preferred embodiment of the invention, $R^5$ and $R^6$ or the acid and alcohol radical form a ring having 8 to 22 ring members.

In a further embodiment of the invention, the use of mono- and diesters of not only dialcohols but also dicarboxylic acids is preferred. Examples of esters which may be mentioned are adipic acid di(2-ethylhexyl ester), 2-ethylhexane-(1,3)-diol mono-n-butyrate, 2-ethylhexane-(1,3)-diol di-n-butyrate. When dicarboxylic acids or dialcohols are used, the acid or alcohol radicals are alkylene or alkenylene groups.

The mixtures of at least one alcohol and at least one ether and/or ester. (component c)) correspond in a preferred embodiment to the following composition:

| Component | Concentration range (% by wt.) |
|---|---|
| Di-2-ethylhexyl ether | 10-25 |
| 2-Ethylhexylic acid 2-ethylhexyl ester | 10-25 |
| $C_{16}$-Lactones | 4-20 |
| 2-Ethylhexyl butyrate | 3-10 |
| 2-Ethylhexane-(1,3)-diol mono-n-butyrate | 5-15 |
| 2-Ethylhexanol | 4-10 |
| $C_4$ to $C_6$ acetates | 2-10 |
| 2-Ethylhexane-(1,3)-diol | 2-5 |
| Ethers and esters > $C_{20}$ | 0-20 |

Such mixtures of at least one alcohol and at least one ether and/or ester with the above described composition are typically obtained as distillation residues during the manufacture of 2-ethyl-1-hexanol.

Preferred anionic water soluble collectors (component d)) which can optionally be combined in concentrations ranging from 1 to 20 wt.-% with the above mentioned water insoluble thionocarbamate collectors, emulsifiers and mixtures of at least one alcohol and at least one ether and/or ester to give aqueous compositions according to the present invention can be chosen from the groups of dialkyl dithiophosphates, diaryl dithiophosphates, dialkyl monothiophosphates, diaryl monothiophosphates, dialkyl dithiophosphinates and mercaptobenzothiazolate. Specially preferred anionic water soluble collectors are the sodium, potassium and/or ammonium salts of diethyl dithiophosphate, diisopropyl dithiophosphate, diisobutyl dithiophosphate, di-sec-butyl dithiophosphate, diisoamyl dithiophosphate and mercaptobenzothiazolate.

In one preferred embodiment the above mentioned composition comprises an additional component d). Component d) may be present in an amount of 1-20 wt.-% and is at least one water soluble anionic collector selected from the group consisting of dialkyl dithiophosphates, diaryl dithiophosphates, dialkyl monothiophosphates, diaryl monothiophosphates, dialkyl dithiophosphinates and mercaptobenzothiazolate.

The composition of the invention is for use as collector in froth flotation processes. Preferably, this use is as a collector in benefication processes of sulfide ores. More preferably, the sulfide ores are ores of copper, cobalt, lead, zinc, nickel, molybdenum, gold, silver and platinum group metals.

The platinum group metals commonly occur as indefinite alloys. In fact, native platinum is always associated with one or another of the platinum group metals, and often with gold, iron and copper. Platinum, Iridium and Osmium exhibit a strong siderophilic character (an affinity for iron) and combine with iron and other transition metals to form alloys. As well as siderophilic, platinum group metals are also chalcophilic (having an affinity for sulfur) and forms compounds with sulfur (cooperate and braggite) rather than with oxygen. They also form compounds with arsenic, selenium, antimony, tellurium and bismuth" (from: Froth Flotation—A Century of Innovation by Fuerstenau, M., Jameson, G. & Yoon. R. (2007)). Platinum group metals may occur in their pure elemental form in nature, this is however a special case. Usually, they are combined with something else.

The present invention is also related to a process for the production of an oil-in-water emulsion with a composition according to the described above, wherein the oil phase is formed by the water insoluble thionocarbamate collector or mixture of collectors and the mixture of at least one alcohol and at least one ether and/or ester. The emulsion can be prepared by using any of the emulsification techniques described elsewhere, see for example "Emulsion Formation and Stability" ed. by Tharwat F. Tadros, Wiley-VCH 2013. in a preferred manufacturing process, the thionocarbamate (component a) is mixed with the surfactant (component b) and the mixture of at least one alcohol and at least one ether and/or ester. (component c) and optionally a water soluble, anionic collector (component d)) to yield a homogeneous mixture, which is poured into water under high mechanical shear generated by a rotor-stator homogenizer to yield a stable emulsion. If desired, the emulsion can be further homogenized under up to 1500 bar in a high-pressure homogenizer to reduce further the emulsions droplet size.

The preferred median droplet size of the emulsions can range from 100 nm to 100 μm. Specially preferred median droplet size of the emulsion is in the range from 100 nm to 1 μm. This droplet size refers to the discontinuous phase of the emulsion.

Furthermore, the present invention also relates to a process for beneficiation of sulfide minerals containing such metals as copper, lead, copper-activated zinc, gold and silver, the process comprising the steps of bringing the mineral ore in contact with an aqueous collector composition according to the present invention and frothing the so formed mineral pulp. It is also possible to add other flotation reagents to the mineral pulp, if these are required. Those can be other collectors, as for example xanthates or solvents like kerosene or diesel, or frothers as for example pine oil, polyglycols, polyoxyparaffins or alcohols.

EXAMPLES

General procedure for preparation of emulsions: water insoluble thionocarbamate collector, emulsifier, mixture of alcohols and esters and/or ethers and optionally a water soluble, anionic collector are mixed under mechanical stirring at room temperature. The homogeneous mixture is slowly poured into the water and homogenized under high mechanical shear using an Ultra Turrax T25-IKA® equipped with dispersing tool consisting of S25N shaft and 25G generator, 6500 rpm around 1 minute and after completed addition further 10 min at 9500 rpm.

The average droplet size in the emulsions was determined by using a light-scattering particle size analyzer, e.g. the Malvern Mastersizer 2000 To measure the droplets size distribution, 1-1.5 ml of emulsion was introduced in the measure compartment than contains about 1000 ml of water.

Composition (wt.-%) and droplet size ($D_{50}$) of the emulsions

| | 1 | 2 | 3 | 4 | 5 | 6 | 7 (comp.) |
|---|---|---|---|---|---|---|---|
| Thionocarbamate (%) | 10 | 10 | 10 | 15 | 10 | 10 | 10 |
| Emulsifier (%) | 4 | 4 | 4 | 4 | 4 | 4 | 4 |
| Mixture of alcohol-ester-ether (%) | 1 | 5 | 3 | 5 | 3 | 3 | — |
| Anionic collector 1 (%) | — | — | — | — | 5 | 3 | — |
| Anionic collector 2 (%) | — | — | — | — | — | 5 | — |
| Water (%) | 85 | 81 | 83 | 76 | 78 | 75 | 86 |
| $D_{50}$ (nm) | 200 | 500 | 245 | 800 | 265 | 255 | 250 |

Emulsions 1 to 6 are examples according to this invention. Emulsion 7 is according to WO 9725149

The water insoluble thionocarbamate present in emulsions 1 to 7 was O-isopropyl-N-ethyl-thionocarbamate.

The emulsifier present in emulsions 1,2,3,5,6 and 7 was a propoxylated (20)-ethoxylated (25) butanol derivative.

The emulsifier present in emulsion 4 was a isotridecyl polyoxyethylene (7EO) acetic acid.

The mixture of alcohols, ethers and esters present in the emulsions 1 to 6 corresponds to the following composition:

| Component | Concentration range (% by wt) |
|---|---|
| Di-2-ethylhexyl ether | 15 |
| 2-Ethylhexylic acid 2-ethylhexyl ester | 12 |
| $C_{16}$-Lactones | 8 |
| 2-Ethylhexyl butyrate | 5.5 |
| 2-Ethylhexane-(1,3)-diol mono-n-butyrate | 10 |
| 2-Ethylhexanol | 5 |
| $C_4$ to $C_6$ acetates | 3 |

-continued

| Component | Concentration range (% by wt) |
|---|---|
| 2-Ethylhexane-(1,3)-diol | 2.5 |
| Ethers and esters > $C_{20}$ | 2 |

The water soluble, anionic collector 1 present in the emulsion 5 and 6 was a 50 wt.-% aqueous solution of the sodium salt of mercaptobenzothiazolate.

The water soluble, anionic collector 2 present in the emulsion 6 was a 35 wt.-% aqueous solution of the sodium salt of diisoamyl dithiophosphate.

The emulsions are stable and did not show separation at room temperature when shelved for a period of 3 months and thereafter.

Flotation Test Results:

Test Procedure

A series of flotation tests were conducted using a sulfide copper ore received from a Chilean copper mine. The ore had a copper content from 0.90-1.0% and a silica content from 43-45%. The received ore was first ground in a stainless steel rod mill until the desired particle size distribution, which was 20%>212 micron, was obtained. This was determined to occur after 35 minutes of milling when the laboratory grinding mill was filled with 1200 g of ore, 600 ml water and 10 stainless steel rods. The mass of the rods was 9210 g. On completion of the grinding stage, the milled slurry was transferred to a 2.5 liter capacity flotation cell, where the percentage solids was adjusted to approximately 35% by adding sufficient tap water until the desired pulp level was attained. Next, the impeller speed was set to 700 rpm and slurry pH adjusted to 10.0 using CaO powder. This pH was maintained throughout the entire test. The flotation procedure followed and the flotation results for both are shown respectively in Tables 1 and 2.

TABLE 1

Flotation procedure

| Time (min) | Sample name | Action | Reagent addition: Collector | Reagent addition: Frother | Reagent addition: CaO |
|---|---|---|---|---|---|
| — | — | Transfer milled slurry to flotation cell | — | — | |
| — | — | Raise slurry level to target by addition of water | — | — | |
| 0-2 | — | Set slurry pH to target (10.0) and condition for 2 minutes | — | — | As is needed for pH 10 |
| 2-4 | — | Add collector (aqueous emulsion) and condition for 2 minutes | 2 g/t or 4 g/t | — | Add if necessary to maintain pH 10 |
| 4-5 | — | Add frother and condition for 1 minute | — | 30 g/t | Add if necessary to maintain pH 10 |
| 5-12 | Concentrate | Open air at 7 l/min and float concentrate | — | — | Add if necessary to maintain pH 10 |
| 12 | — | Close air; end of test | | | |

TABLE 2

Results of the flotation tests

| Flotation Test | Collector | Dosage Thionocarbamate (g per ton ore) | Cu Recovery (%) | Cu Grade (%) |
|---|---|---|---|---|
| 1 | Emulsion 1 | 2 | 85.77 | 6.25 |
| 2 | Emulsion 2 | 2 | 86.18 | 5.82 |
| 3 | Emulsion 3 | 2 | 87.13 | 6.47 |
| 4 | Emulsion 4 | 2 | 85.10 | 6.43 |
| 5 | Emulsion 5 | 2 | 86.89 | 5.02 |
| 6 | Emulsion 6 | 2 | 86.94 | 6.71 |
| 7 | Emulsion 3 | 4 | 88.59 | 5.68 |
| 8 (comparison) | Emulsion 7 | 2 | 84.58 | 6.94 |
| 9 (comparison) | O-isopropyl-N-ethyl-thionocarbamate (100%) | 2 | 82.24 | 6.15 |
| 10 (comparison) | O-isopropyl-N-ethyl-thionocarbamate (100%) | 4 | 85.12 | 6.33 |

The results from the flotation tests show that the collector compositions according to this invention (emulsions 1 to 6) show excellent flotation efficiency and in particular, improved copper recovery in comparison with the emulsion 7, which only contains thionocarbamate, emulsifier and water as described in WO 9725149. Moreover, the emulsions 1 to 6 according to this invention show improved flotation efficiency than pure thionocarbamate collector.

The Cu grade obtained with the inventive emulsions is slightly lower than what was obtained with the emulsion 7 in the laboratory experiments. This difference in Cu grade is considered negligible because industrial flotation plants typically put the rougher concentrate through two, three or even four cleaning steps. In this way, the Cu grade of the final concentrate is typically increased to >20%. Furthermore, in the unlikely event that this small concentrate grade reduction is transferred to a plant scale (even considering two or three cleaning steps was done), a 1.0-1.5% increase in Cu recovery is still much more beneficial for economic reasons.

References to "%" mean wt.-% if not otherwise indicated.

The invention claimed is:

1. A composition in form of a stable aqueous emulsion comprising a) 1-50 wt.-% of at least one water insoluble thionocarbamate collector selected from the group consisting of dialkyl thionocarbamates, alkyl alkoxycarbonyl thionocarbamates and alkyl allyl thionocarbamates, b) 1-50 wt.-% of one or a mixture of surface active agents of the general formula

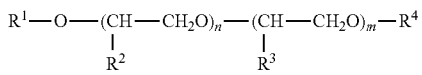

wherein $R^1$ is a saturated or unsaturated, branched or linear $C_3$ to $C_{30}$ aliphatic or aromatic hydrocarbon group, $R^2$ and $R^3$ are independently from each other hydrogen or a $C_1$ to $C_4$ alkyl group, $R^4$ is hydrogen or —$CH_2$—COOX, where X is hydrogen or sodium salt or potassium salt or ammonium salt, and n and m are independently from each other 0 to 50, c) 0.1-20 wt.-% of a mixture of at least one alcohol and at least one ether and/or ester, and e) 1-90 wt.-% of water, wherein the at least one ether corresponds to the formula $$R^5—O—R^6$$

wherein $R^5$ is a linear or branched alkyl or alkenyl group having 2 to 30 carbon atoms and $R^6$ is a linear or branched alkyl or alkenyl group having 1 to 30 carbon atoms.

2. The composition of claim 1 wherein the water insoluble thionocarbamate collector is O-isopropyl-N-ethyl-thionocarbamate.

3. The composition of claim 1, wherein the surface active agent is described by the general formula $$R^1—O—(\underset{\underset{R^2}{|}}{CH}—CH_2O)_n—(\underset{\underset{R^3}{|}}{CH}—CH_2O)_m—R^4$$

wherein $R^1$ is a saturated or unsaturated, branched or linear $C_3$ to $C_{18}$ aliphatic or aromatic hydrocarbon group $R^2$ and $R^3$ are independently from each other hydrogen or $C_1$ to $C_4$ alkyl group $R^4$ is hydrogen and n and m are independently from each other 0 to 50.

4. The composition as claimed in claim 1, wherein the alcohol is selected from the group consisting of monohydric alcohols and diols.

5. The composition as claimed in claim 1, wherein the alcohol comprises a hydrocarbon radical having from 8 to 14 carbon atoms.

6. The composition as claimed in claim 1, wherein the alcohol has a solubility in water of less than 50 g/liter at 20° C. determined according to the OECD guideline 105.

7. The composition as claimed in claim 1, wherein the alcohol is 2-ethylhexanol and/or 2-ethylhexane-(1,3)-diol.

8. The composition as claimed in claim 1, wherein the ether is cyclic, the ring is formed by $R^5$ and $R^6$ and the ring size is from 6 to 30 carbon atoms.

9. The composition as claimed in claim 1, wherein $R^5$ is an alkyl or alkenyl group having 4 to 22 carbon atoms.

10. The composition as claimed in claim 1, wherein $R^6$ is an alkyl or alkenyl group having 2 to 22 carbon atoms.

11. The composition as claimed in claim 1, wherein the esters are derived from monobasic or polybasic carboxylic acids having 2 to 30 carbon atoms in the acid radical and monohydric or polyhydric alcohols having 1 to 30 carbon atoms in the alcohol radical.

12. The composition as claimed in claim 11, wherein the acid radical is an alkyl or alkenyl group having 4 to 22 carbon atoms.

13. The composition as claimed in claim 11, wherein the alcohol radical is an alkyl or alkenyl group having 2 to 22 carbon atoms.

14. The composition as claimed in claim 1, wherein the ethers and/or esters are selected from the group consisting of dihexyl ether, dioctyl ether, di-(2-ethylhexyl) ether, oleic acid eicosyl ester, 2-ethylhexyl stearate, 2-ethylhexylic acid butyrate, octanoic acid ethyl ester, hexanoic acid ethyl ester, 2-ethylhexylic acid butyl ester, 2-ethylhexyl butyrate and 2-ethylhexylic acid 2-ethylhexyl ester, adipic acid di(2-ethylhexyl ester), 2-ethylhexane-(1,3)-diol mono-n-butyrate, and 2-ethylhexane-(1,3)-diol di-n-butyrate.

15. The composition as claimed in claim 1, wherein the mixture of at least one alcohol and at least one ether and/or ester corresponds to the composition

| Component | Concentration range (% by wt.) |
|---|---|
| Di-2-ethylhexyl ether | 10-25 |
| 2-Ethylhexylic acid 2-ethylhexyl ester | 10-25 |
| $C_{16}$-Lactones | 4-20 |
| 2-Ethylhexyl butyrate | 3-10 |
| 2-Ethylhexane-(1,3)-diol mono-n-butyrate | 5-15 |
| 2-Ethylhexanol | 4-10 |
| $C_4$ to $C_6$ acetates | 2-10 |
| 2-Ethylhexane-(1,3)-diol | 2-5 |
| Ethers and esters > $C_{20}$ | 0-20 |

16. The composition as claimed in claim 1, wherein component c) is a product obtained from distillation residues of the 2-ethyl-1-hexanol production process.

17. The composition as claimed in claim 1, further comprising an additional water soluble anionic collector (component d) in an amount of 1 to 50 wt.-%, wherein the additional water soluble anionic collector is selected from the group consisting of diisoamyl dithiophosphate, diethyl dithiophosphate, diisopropyl dithiophosphate, diisobutyl dithiophosphate, disecbutyl dithiophosphate, and mercaptobenzothiazolate.

18. The composition as claimed in claim 1, wherein the median droplet size of the discontinuous phase is from 100 nm to 100 μm.

19. A process for manufacturing a stable aqueous emulsion comprising the steps of mixing a thionocarbamate (component a), selected from the group consisting of dialkyl thionocarbamates, alkyl alkoxycarbonyl thionocarbamates and alkyl allyl thionocarbamates, with a surface active agent (component b) of the general formula $$R^1—O—(\underset{\underset{R^2}{|}}{CH}—CH_2O)_n—(\underset{\underset{R^3}{|}}{CH}—CH_2O)_m—R^4$$

wherein $R^1$ is a saturated or unsaturated, branched or linear $C_3$ to $C_{30}$ aliphatic or aromatic hydrocarbon group, $R^2$ and $R^3$ are independently from each other hydrogen or a $C_1$ to $C_4$ alkyl group, $R^4$ is hydrogen or $—CH_2—COOX$, where X is hydrogen or sodium salt or potassium salt or ammonium salt, and n and m are independently from each other 0 to 50, and a mixture of at least one alcohol and at least one ether and/or ester (component c) and optionally a water soluble, anionic collector (component d) to yield a homogeneous mixture, and adding the homogenous mixture to water under high mechanical shear generated by a rotor-stator homogenizer to form the stable aqueous emulsion, wherein the at least one ether corresponds to the formula $$R^5—O—R^6$$

wherein $R^5$ is a linear or branched alkyl or alkenyl group having 2 to 30 carbon atoms and $R^6$ is a linear or branched alkyl or alkenyl group having 1 to 30 carbon atoms.

20. The process according to claim 19, further comprising the step, wherein the stable aqueous emulsion is homogenized under a pressure of atmospheric pressure to up to 1500 bar in a high-pressure homogenizer.

21. A process for beneficiation of a metal sulfide mineral or ore, the process comprising the steps of bringing the mineral or ore in contact with an aqueous collector composition comprising a stable aqueous emulsion, wherein the stable aqueous emulsion comprises a) 1-50 wt.-% of at least one water insoluble thionocarbamate collector selected from the group consisting of dialkyl thionocarbamates, alkyl alkoxycarbonyl thionocarbamates and alkyl allyl thionocarbamates, b) 1 -50 wt.-% of one or a mixture of surface active agents of the general formula

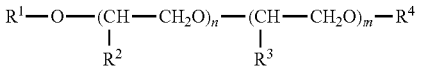

wherein $R^1$ is a saturated or unsaturated, branched or linear $C_3$ to $C_{30}$ aliphatic or aromatic hydrocarbon group, $R^2$ and $R^3$ are independently from each other hydrogen or a $C_1$ to $C_4$ alkyl group, $R^4$ is hydrogen or —$CH_2$—COOX, where X is hydrogen or sodium salt or potassium salt or ammonium salt, and n and m are independently from each other 0 to 50, c) 0.1-20 wt.-% of a mixture of at least one alcohol and at least one ether and/or ester, and e) 1-90 wt.-% of water, to form a mineral pulp, and subsequently frothing the mineral pulp, wherein the at least one ether corresponds to the formula $R^5$—O—$R^6$ wherein $R^5$ is a linear or branched alkyl or alkenyl group having 2 to 30 carbon atoms and $R^6$ is a linear or branched alkyl or alkenyl group having 1 to 30 carbon atoms.

22. The process as claimed in claim 21, wherein the metal is selected from the group consisting of copper, cobalt, lead, zinc, nickel, molybdenum, gold, silver and platinum group metals.

23. The process according to claim 22, wherein the amount of the aqueous collector composition added is an amount between 0.5 g and 1000 g per ton of ore.

* * * * *